US010669789B2

(12) United States Patent
Budler et al.

(10) Patent No.: US 10,669,789 B2
(45) Date of Patent: Jun. 2, 2020

(54) NON-METALLIC CENTRALIZER FOR DOWNHOLE DRILLING APPARATUS

(71) Applicant: Oil States Industries, Inc., Arlington, TX (US)

(72) Inventors: Nicholas Frederick Budler, Claremore, OK (US); Jimmy Dale Sandsness, Mounds, OK (US)

(73) Assignee: Oil States Industries, Inc., Arlington, TX (US)

( * ) Notice: Subject to any disclaimer, the term of this patent is extended or adjusted under 35 U.S.C. 154(b) by 0 days.

(21) Appl. No.: 16/448,832

(22) Filed: Jun. 21, 2019

(65) Prior Publication Data

US 2019/0338602 A1 Nov. 7, 2019

Related U.S. Application Data

(63) Continuation-in-part of application No. 15/670,327, filed on Aug. 7, 2017.

(60) Provisional application No. 62/372,199, filed on Aug. 8, 2016.

(51) Int. Cl.
*E21B 17/10* (2006.01)

(52) U.S. Cl.
CPC ..... *E21B 17/1078* (2013.01)

(58) Field of Classification Search
CPC ..... E21B 17/10
See application file for complete search history.

(56) References Cited

U.S. PATENT DOCUMENTS

| | | | | |
|---|---|---|---|---|
| 6,283,205 | B1 | 9/2001 | Cannon | |
| 2003/0010540 | A1 | 1/2003 | Kirk et al. | |
| 2007/0007015 | A1 | 1/2007 | Thornton | |
| 2011/0114338 | A1 | 5/2011 | Casassa et al. | |
| 2012/0186828 | A1 | 7/2012 | Lively et al. | |
| 2013/0319690 | A1 | 12/2013 | Levie et al. | |
| 2016/0002986 | A1* | 1/2016 | Dicke | E21B 17/1028 166/285 |

FOREIGN PATENT DOCUMENTS

WO 2016028260 A1 2/2016

OTHER PUBLICATIONS

Notification of Transmittal of the International Search Report and Written Opinion filed in PCT/US2017/045779, dated Oct. 19, 2017.

* cited by examiner

*Primary Examiner* — Giovanna Wright
*Assistant Examiner* — Dany E Akakpo
(74) *Attorney, Agent, or Firm* — Blank Rome LLP

(57) ABSTRACT

A non-metallic centralizer for use with downhole operations. The centralizer is formed of a hollow, cylindrical body, a plurality of non-metallic blades protruding from the outer surface of the cylindrical body, and a plurality of wear buttons positioned on each of the plurality of blades, each of the wear buttons having a surface designed to reduce grabbing or sticking and wear of the hollow cylindrical body.

21 Claims, 4 Drawing Sheets

NON-METALLIC CENTRALIZER FOR DOWNHOLE DRILLING APPARATUS

CROSS-REFERENCE TO RELATED APPLICATIONS

The present application is a continuation-in-part of U.S. application Ser. No. 15/670,327, filed on Aug. 7, 2017, titled "Polymer-Based Centralizer for Downhole Drilling Apparatus", which claims priority to U.S. Provisional Patent Application No. 62/372,199, filed Aug. 8, 2016, each of which is hereby incorporated herein by reference in their entirety.

FIELD OF THE INVENTION

The invention relates to a composite solid centralizer for downhole drilling operations, such as for use in oil or gas wells, which reduces wear and abrasion while the centralizer travels downhole as part of the casing string.

BACKGROUND

Oil and gas drilling is a complex process in which a variety of different types of equipment is used. Generally, once a well bore is drilled to a pre-set depth into the earth, a casing, typically a cylindrical tube, is run into the well bore and cemented in place. This provides structural stability to the well and permits the operator to selectively produce and treat only certain zones. To ensure that the casing is centered in the well bore, so that it does not lean against the wall of the well bore, a device called a centralizer is positioned around the casing. The purpose of centralizers is at least two-fold. First, while the casing string is being run into the hole, the centralizers reduce the torque and drag factors seen by the operator while getting the casing to depth (some are designed to allow the casing string to rotate independently to further reduce friction while running in the hole). Another purpose is to center (or centralize) the casing once it has been run to total depth, so that when the cement is pumped, it can circulate all around the casing string to provide a good cement job. Typically, this means that cement has successfully been placed 360 degrees around the casing without a noticeable "wide" or "narrow" side to the annulus. Centralizers are typically formed as hollow-cylindrical tubes, although other types of centralizer geometries are also known. Once the casing is in place and is centered in the well bore with the centralizer, cement is pumped around the outer surface of the casing, between the outer surface of the casing and the wall of the well bore, in order to seal the well bore and to structurally support the casing. Once total depth is reached and all casing strings are cemented in the hole, the well can be selectively completed to allow oil to be extracted through the casing in a controlled manner.

Use of a centralizer in this process is important because, if the casing is not centered in the well bore, the annular cement layer will not form a strong bond in the area where the casing makes contact with the wall of the well bore, thus reducing the mechanical integrity of the well and reducing the proficiency of zonal isolation between formations. Conventional centralizers come in a variety of types, including solid centralizers which are formed of a hollow, cylindrical body having longitudinal blades on an outer surface extending along a length thereof. The blades can be solid, or spring-like blades. Solid centralizers are typically formed of metal or polymer materials. The spring-like blades are typically made of a metal material. Conventional steel or aluminum centralizers work well for their intended purpose, but they are heavy, difficult to handle, and do not provide a low coefficient of friction between the centralizer and the well wall (either casing, if there is casing already set in the upper portion of the well, or formation) thus causing the centralizers to experience high torque and drag forces. Polymer-based centralizers have become an attractive alternative to metal or alloy-based centralizers to alleviate some of the problems above. Use of a polymer material greatly reduces the coefficient of friction, thus reducing the torque and drag forces to which the centralizers are objected. However, polymer-based centralizers have their own disadvantages, in that they are worn down more easily by the abrasive forces of running in hole due to their lower mechanical strength. As a result, they can be worn down completely in some cases, thereby eliminating the centralizing function and potentially causing poor cement jobs where the casing string lays directly against the formation, thus increasing the health, safety, and environmental concerns, since the zones in the formation may not be effectively isolated.

Some attempts have been made to include projections on an outer surface of the centralizer, particularly the centralizer blades, to reduce the frictional forces exerted on the centralizer. For example, metallic centralizers have been formed with Teflon™ projections on an outer surface of the centralizer in order to reduce torque and drag forces while running downhole. However, such projections are sacrificial, i.e. wear down quickly, as the mechanism to reduce frictional forces, thus reducing torque and drag on the centralizer. That can be effective when the underlying blades are made of metal so as not to be sacrificed themselves, but in the situation where the underlying blade is a polymer material, the blade itself would also be quickly sacrificed, causing the problems outlined above.

What is needed is a solution for polymer blades to reduce wear and abrasion without sacrificing the wear reducers and subsequently the polymer blades themselves.

SUMMARY OF THE INVENTION

Accordingly, the invention is directed to a polymer-based solid centralizer with solid polymer blades, where buttons of material specifically designed to reduce wear and abrasion are added to the exterior of the blades to reduce wear and abrasion experienced when running downhole, thereby extending the life of the centralizer and reducing the risk of catastrophic failure of the well.

One aspect of the invention is a centralizer for use with downhole operations, such as drilling apparatus, which includes a hollow, cylindrical body having an exposed outer surface and formed of a non-metallic material, a plurality of blades formed of non-metallic material, protruding from the outer surface of the hollow cylindrical body, and a plurality of wear buttons positioned on each one of the plurality of blades, each of the wear buttons having a surface designed to reduce friction.

Another aspect of the invention is a centralizer for use in downhole processes, which includes a hollow, cylindrical body having an exposed outer surface and formed of a non-metallic composite material, a plurality of non-metallic blades protruding from the outer surface of the cylindrical body and oriented in a parallel or spiral arrangement, and a plurality of substantially cylindrical ceramic wear buttons positioned on each of the plurality of blades, each of the wear buttons having an exposed and smooth curved surface.

The invention is also directed to a centralizer for use with downhole apparatus, which includes a hollow, cylindrical body having an exposed outer surface and formed of a non-metallic material, a plurality of blades protruding from the outer surface of the hollow cylindrical body, a plurality of wear buttons protruding from each one of the plurality of blades, each of the wear buttons having a surface designed to reduce friction. The plurality of blades and plurality of wear buttons are formed of the same non-metallic material.

The present invention may also provide a non-metallic centralizer for use with a downhole apparatus that comprises a hollow, cylindrical body having an outer surface that has a plurality of blades protruding outwardly from the outer surface, and the plurality of blades are formed of a first non-metallic material. A plurality of wear buttons are associated with one or more of the plurality of blades. Each of the plurality of wear buttons is formed of a second non-metallic material that has a static coefficient of friction to steel that is equal to or greater than a static coefficient of friction to steel of the first non-metallic material. The wear buttons are configured to reduce abrasive forces exerted upon the centralizer when run into the downhole apparatus.

In certain embodiments, the static coefficient of friction to steel of the first non-metallic material is about 0.17 and the static coefficient of friction to steel of the second non-metallic material is about 0.3; the static coefficient of friction to steel of the blade's non-metallic material is less than 0.8 and the static coefficient of friction to steel of the wear buttons' non-metallic material is greater than the static coefficient of friction to steel of the blade's non-metallic material and less than 0.8; the first non-metallic material is a polymer or composite polymer; the second non-metallic material is a polymer or composite polymer; and/or the second non-metallic material is polytetrafluoroethylene, polyetheretherketone, dicyclopentadiene polymer, ceramic, carbide, zirconia, or combinations thereof.

In other embodiments, each of the plurality of wear buttons has an exposed wear face that is smooth and rounded; each of the plurality of blades includes a bevel at each end thereof and at least one of the plurality wear buttons is disposed in the bevel in each end; each of the plurality of blades includes at least four of the wear buttons, each of the wear buttons is spaced equally apart along a length of each of the plurality of blades; and/or the plurality of wear buttons are disposed in the one or more of the plurality of blades such that the plurality of wear buttons do not extend beyond a maximum outer diameter of the centralizer defined by the plurality of blades.

The present invention may yet further provide a non-metallic centralizer for use with a downhole apparatus, that comprises a hollow, cylindrical body that has an outer surface and first and second opposite open ends and a plurality of blades protruding outwardly from the outer surface where each of the plurality of blades extends from near or at the first open end to near or at the second open end of the hollow cylindrical body. The plurality of blades defining a maximum outer diameter of the centralizer and are formed of a non-metallic material. A plurality of wear buttons are disposed in one or more of the plurality of blades such that the plurality of wear buttons do not extend beyond a maximum outer diameter of the centralizer defined by the plurality of blades. Each of the plurality of wear buttons being formed of a non-metallic material and are configured to reduce abrasive forces exerted upon the centralizer when run into the downhole apparatus.

In some embodiments, the plurality of wear buttons are positioned below or at an outermost surface of the one or more of the plurality of blades; the one or more of the plurality of blades include recesses in the outer most surface, each recess receives one of the plurality of wear buttons; each of the plurality of wear buttons has a smooth wear face that is exposed at the outermost surface of the one or more of the plurality of blades; each of the smooth wear faces is rounded; each of the plurality of blades has a length between first and second blade ends corresponding to the first and second opposite open ends, respectively, of the cylindrical body, at least one of the plurality of wear buttons is located at each of the first and second blade ends; one or more of the plurality of wear buttons are located between the first and second ends; each of the first and second blade ends includes a bevel and the at least one of the plurality of wear buttons is positioned in the bevel of the first and second blade ends; the non-metallic material of the plurality of wear buttons has a static coefficient of friction to steel that is equal to or greater than a static coefficient of friction of steel of the non-metallic material of the plurality of blades; and/or the static coefficient of friction to steel of the non-metallic material of the plurality of wear buttons is about 0.17 and the static coefficient of friction to steel of the non-metallic material of the plurality of blades is about 0.3.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

As described herein, the solid centralizer of the invention may be used in downhole applications, such as in oil and gas wells, to help to center the casing in the wellbore. Once the casing is in place and is centered by the centralizer, cement is poured around the outer surface of the casing, between the outer surface of the casing and the wall of the well bore, in order to seal the well bore and to structurally support the casing. If the casing is not centered in the well bore, the annular cement layer will not form a strong bond in the area where the casing makes contact with the wall of the well bore, thus reducing the mechanical integrity of the well. The invention provides a non-metallic solid centralizer that is easy to handle in the field and that reduces wear down caused by the abrasive effect of the run-in-hole and pumping processes.

In one embodiment, the centralizers disclosed herein are preferably formed of a non-metallic material, so as to decrease their weight and make them easier to handle when in use. The centralizers of the invention may be formed of, for example, polymers, including plastics, resins, phenolic-based compounds, and nylon-based compounds, composites, such as filament wound composites formed of carbon fiber or fiberglass materials, and injection grade materials. This list is not exhaustive, and any non-metallic material that provides the structural integrity similar to those described may be used to form the centralizers of the invention.

Figure 1:
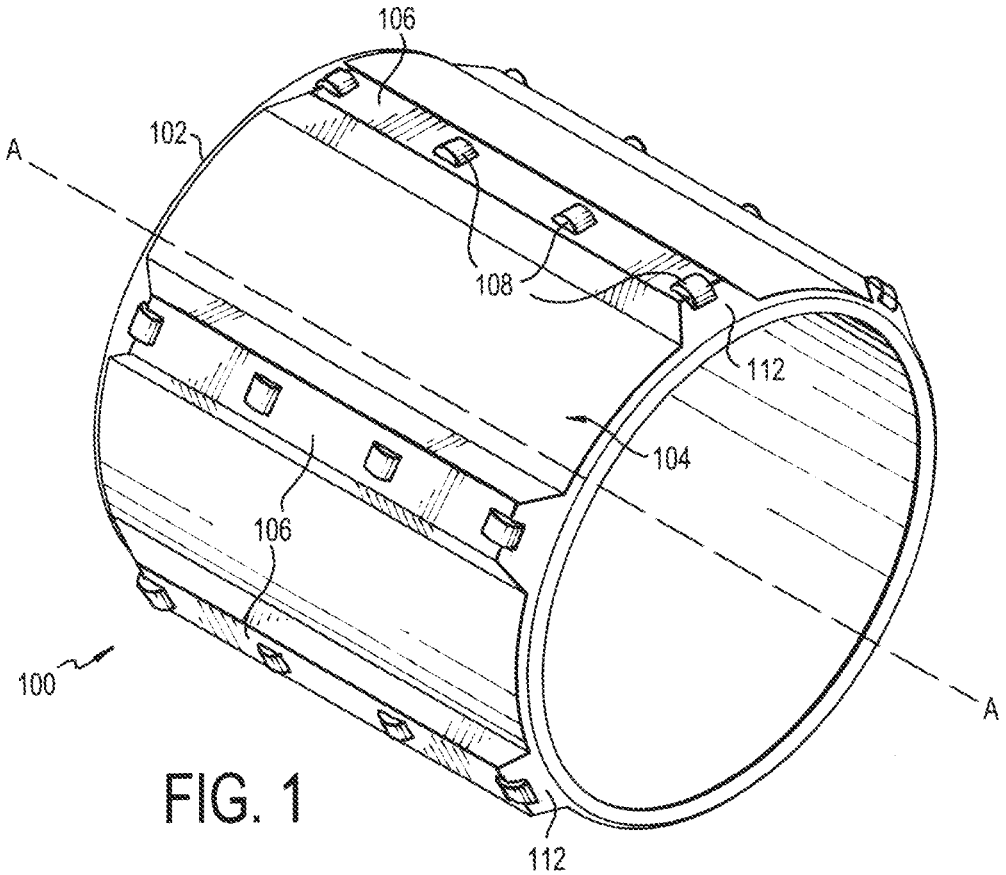
FIG. 1 is a perspective view of a centralizer in accordance with an embodiment of the invention.
Figure 2:
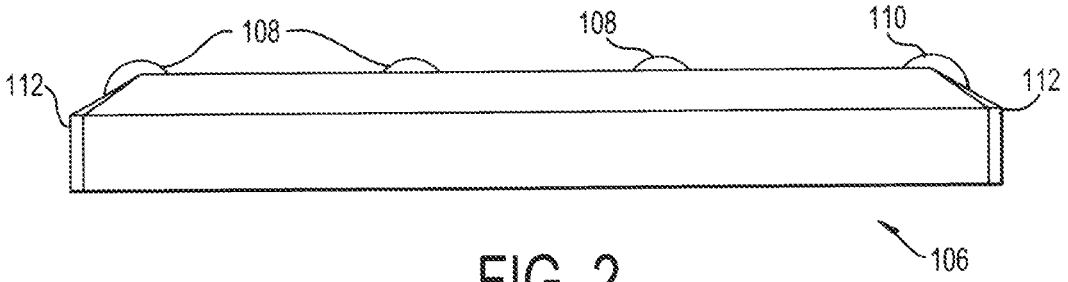
FIG. 2 is side plan view of a blade of the centralizer illustrated in FIG. 1.

As illustrated in FIGS. 1 and 2, a centralizer 100 according to an embodiment of the invention is generally formed of a hollow, cylindrical body 102 (the "body 102") having an outer surface 104. The centralizer 100 includes a plurality of protruding blades 106 extending along a length of the outer surface 104 of the body 102. In one embodiment, each of the blades 106 extends along the entire length of the outer surface 104 of the body from one end to the other end, i.e. the blades are straight along the longitudinal body 102 of the centralizer 100. In the embodiment illustrated in FIG. 1, the blades 106 are oriented such that they are parallel to one another and parallel to an axis A upon which the length of the body 102 extends. The blades 106 may be formed integrally with the body 102, or the blades 106 may be coupled to the body 102 using any attachment mechanisms known in the art.

As shown in FIG. 2, each of the blades 106 may have a generally rectangular shape, with beveled edges 112 at either end. In an alternative embodiment not shown, the blades 106 may not have the beveled edges 112 and may have a purely rectangular shape. In yet another embodiment, the blades 106 may be ovular, such that the blade 106 has a slight curvature from one end to the other end.

The centralizer 100 further includes a plurality of wear buttons 108 that are positioned on each of the blades. In one embodiment, each of the blades 106 has at least two (2) wear buttons 108, but preferably at least three (3) wear buttons 108, and more preferably at least four (4) wear buttons 108 (as illustrated in FIG. 1). It should be noted, however, that the number of wear buttons 108 on each blade 106, and in total, may vary depending on the size of the centralizer 100 and the particular application. The wear buttons 108 are preferably positioned such that there is one at either end of the blade 106, such that they are located at the interface of the maximum outer diameter of the blade 106 and the entry angle of the centralizer, otherwise known as the beveled edge 112. In one embodiment, the wear buttons 108 are preferably spaced equally apart from one another along each of the blades 106 so as to evenly distribute the load upon any given blade 106.

The wear buttons 108 may take a variety of shapes and sizes, as long as their exposed surface 110 (see FIG. 2) has a smooth interface so as not to induce "grabbing" or "biting" into the casing material or formation as the centralizer 100 is run into the hole, which would increase the abrasive forces imposed on the centralizer 100. In one embodiment, each wear button 108 is generally formed of a substantially cylindrical shape having an exposed surface 100 that takes the shape of a curved face aligned with axis A of the length of the body 102 (see FIG. 1). In other embodiments, the wear buttons 108 may have a substantially spherical or ovular shape, or any other geometry that is smooth on the exposed surface 110.

The wear buttons 108 are preferably formed of a hard, resilient material that is different than the non-metallic material used to form the rest of the centralizer 100. For example, the material used to form the wear buttons 108 may include, but is not limited to, ceramic, polyetheretherketone (PEEK), carbides, zirconia, or combinations thereof. These non-metallic materials will generally have a coefficient of friction to steel that is less than 0.8 (value for steel on steel), preferably with coefficients of friction to steel less than 0.35 (bronze on steel), more preferably with coefficients of friction to steel that are largely similar to 0.05 (PTFE on steel). These materials reduce the effect of abrasion and are therefore much less likely to wear down during use as compared to other known centralizer designs. In this way, the integrity of the centralizer 100, and thus the entire oil or gas well, may be improved. In one embodiment, each of the wear buttons 108 is formed of the same material, such as one of those set forth above. In an alternative embodiment, the wear buttons 108 may be formed of a mixture of materials, such as one or more of those set forth above. In another embodiment, each button 108 may be made of one of the materials listed above, but the blades 106 may have buttons 108 of different materials installed, such as if certain parts of the blades 106 are expected to receive the most wear, potentially higher quality, more expensive material can be used for buttons in that area, where less efficient but less expensive material may be used for the remaining buttons 108.

In one embodiment, the wear buttons 108 are coupled to each of the blades 106 using either chemical or mechanical attachment methods. In another embodiment, the buttons 108 are molded into and made integral with the blades 106. It should be noted that while the preferred embodiments discuss buttons 108, the invention could use strips of wear resistant material or other types of configurations of the non-wear material where the material is designed to be in contact with the casing or formation while running in the hole without catching or grabbing so as to redistribute the observed frictional force across the entire strip and not isolate it to a singular button.

Figure 3:
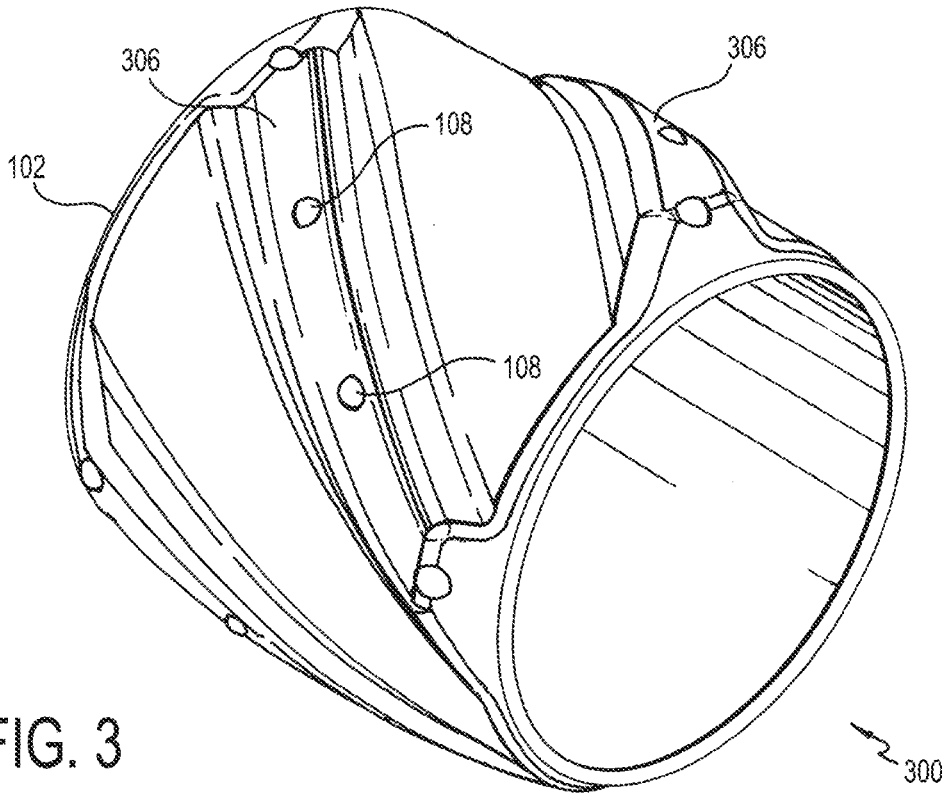
FIG. 3 is a perspective view of a centralizer in accordance with an embodiment of the invention.

In another embodiment illustrated in FIG. 3, a centralizer 300 has generally the same shape as centralizer 100, but the blades 306 are oriented in a spiral pattern along the length of the body 102. The centralizer 300 of FIG. 3 also preferably includes wear buttons 108 similar to those illustrated in FIGS. 1 and 2, with similar shape, size and location, or any other geometry contemplated herein. Likewise, the non-wear material could be applied in strips or other configurations to reduce wear and abrasion going in the hole.

Figure 4:
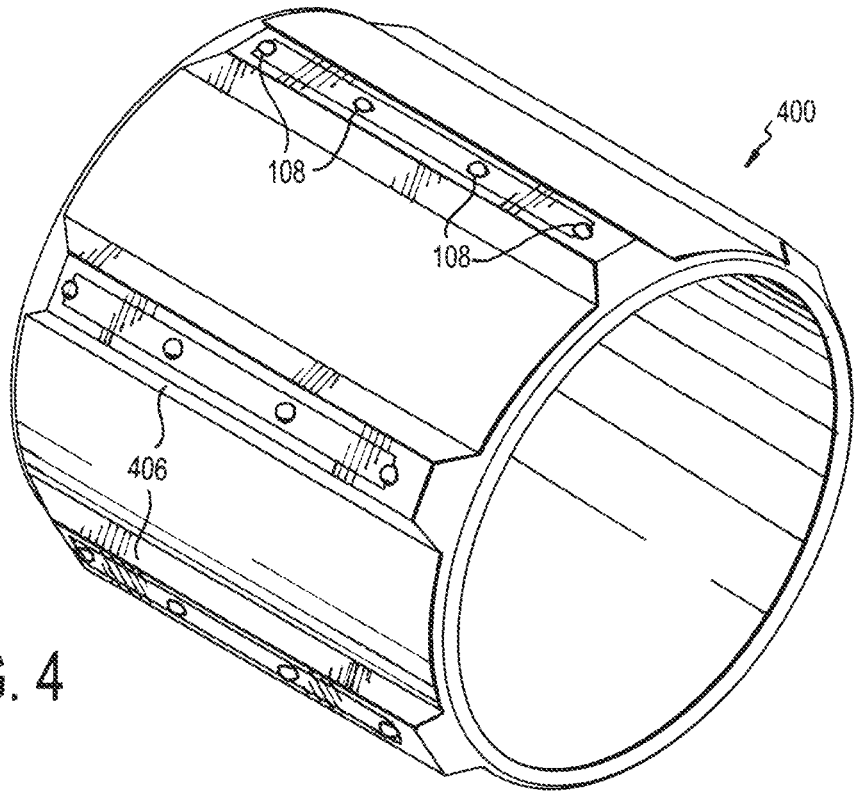
FIG. 4 is a perspective view of a centralizer in accordance with an embodiment of the invention.

In yet another embodiment illustrated in FIG. 4, centralizer 400 has generally the same shape as centralizer 100, but the blades 406 are formed of the same material as the wear buttons 108, including those example materials set forth herein. In this way, each singular pad has the properties of the wear buttons 108, but encompasses the whole blade 406. In this embodiment, the blades 406 may be formed integrally with the wear buttons 108, or the wear buttons 108 may be attached using the mechanisms set forth herein to each of the blades 406.

Figure 5:
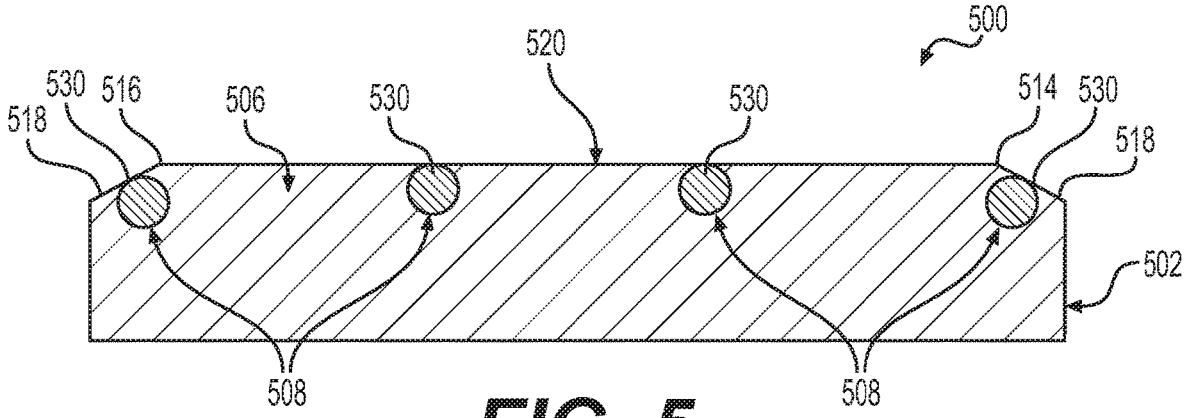
FIG. 5 is a partial cross-sectional view of a centralizer in accordance with another embodiment of the invention.
Figure 6:
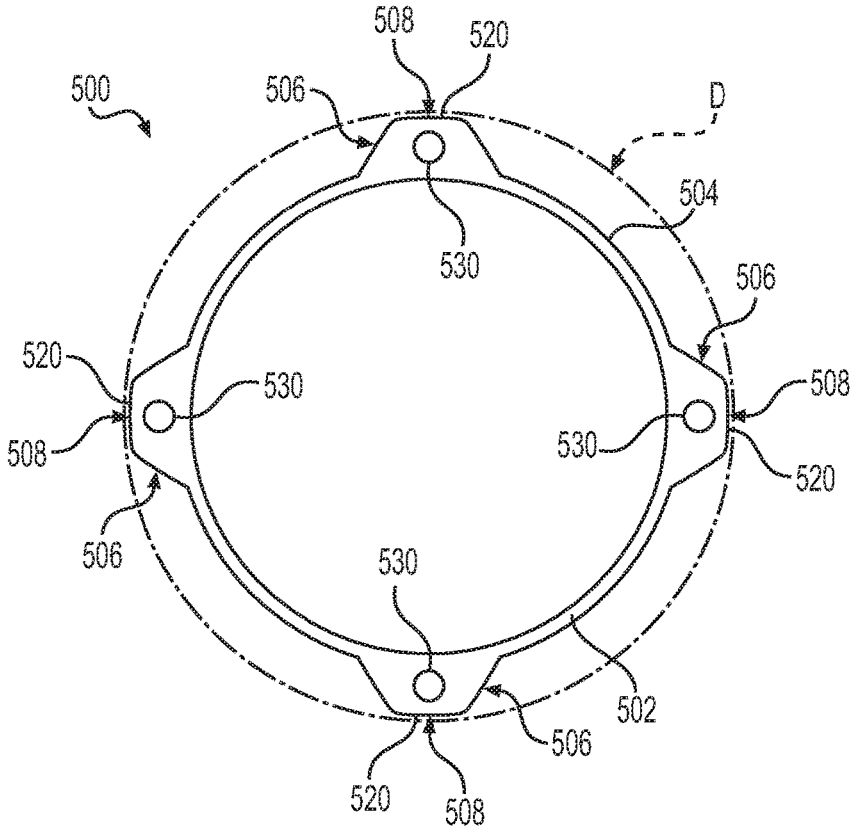
FIG. 6 is an end plan view of the centralizer illustrated in FIG. 5.
Figure 7:
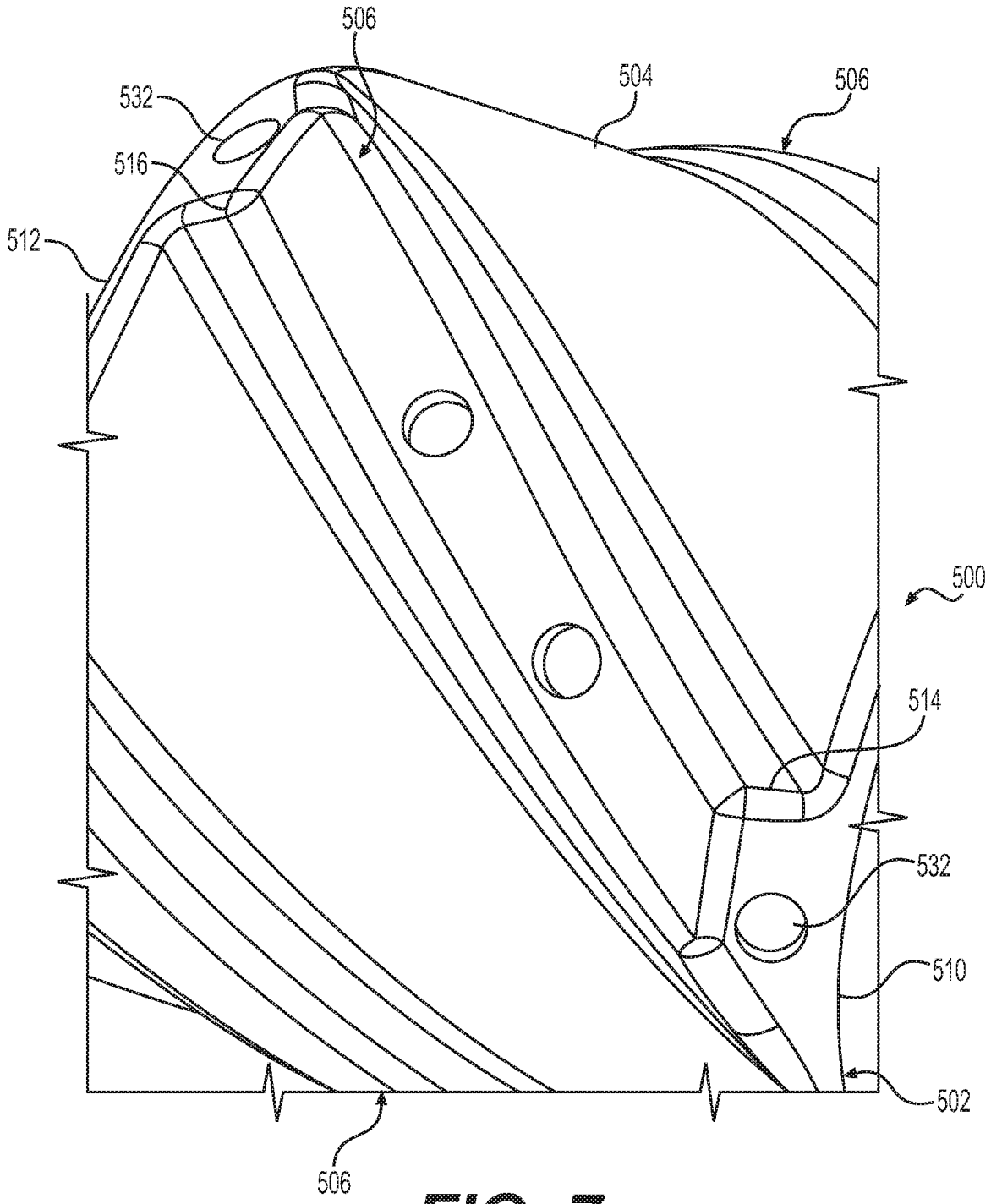
FIG. 7 is a partial perspective view of the centralizer illustrated in FIG. 5.

FIGS. 5-7 illustrate a non-metallic centralizer 500 according to a further exemplary embodiment of the present invention that comprises a hollow, generally cylindrical body 502 that has an outer surface 504, a plurality of protruding blades 506 protruding outwardly from outer surface 504, and a plurality of wear buttons 508 associated with the blades 506 configured to reduce abrasive forces exerted upon the centralizer 500 when it is run into the downhole apparatus, similar to centralizer 100 according to the first embodiment. The body 502 has a length with opposite first and second opposite open ends 510 and 512. Each of the blades 506 may extend the length of the body 502 such that each blade 506 extends from near or at the first open end 510 to near or at the second open end 512, as seen in FIG. 7. The blades 506 may extend along a length of the body's outer surface 504 in a straight or spiral pattern orientation, similar to the above embodiments. The blades 506 may be formed integrally with the body 502 or the blades 506 may be coupled to the body 502 using any attachment mechanisms known in the art. Each of the blades 506 may have a generally rectangular shape, with opposite ends 514 and 516 that generally correspond to the body's open ends 510 and 512, respectively. Each blade end 514 and 516 may have a bevel or beveled edge 518. In an alternative embodiment, each blade end 514 and 516 may be curved instead of beveled.

The wear buttons 508 are disposed in at least one and preferably all of the blades 506 such that the wear buttons 508 are flush with or just under the outermost surface 520 of each blade 506, as seen in FIG. 5, with each wear button 508 having a wear face 530 that is exposed near or at outermost surface 520. That is, the wear buttons 508 preferably do not extend beyond the outermost surface 520 of the respective blade 506. Each of the blades 506 may have a plurality of the wear buttons 508 disposed therein with at least one wear button 508 positioned in the bevel 518 at each of the blade ends 514 and 516. The wear buttons 508 are preferably positioned at either end 514 and 516 of the blade 506, such that they are located at the interface of the maximum outer diameter D and entry angle (into the downhole) of the centralizer 500. Like in the above embodiments, the wear buttons 508 may be spaced equally apart from one another along each of the blades 506 so as to evenly distribute the load upon any given blade 506.

In one embodiment, the blades 506 are formed of a first non-metallic material and the wear buttons 508 are formed of a second non-metallic material where the second non-metallic material has a static coefficient of friction to steel that is equal to or greater than the static coefficient of friction to steel of the first non-metallic material. The static coefficient of friction of a material to steel is the friction force between an object made of that material and an object made of steel, respectively, when neither object is moving. The wear buttons 508 may be formed of any non-metallic material as long as the non-metallic material of the wear buttons 508 has a static coefficient of friction to steel that is equal to or greater than the static coefficient of friction to steel of the non-metallic material of the blades 506. This ensures that the wear buttons 508 will still provide wear protection to the centralizer 500 even if or when the blades 506 wear down.

In one embodiment, the static coefficient of friction to steel of the blades' non-metallic material is about 0.17 and the static coefficient of friction to steel of the wear button's non-metallic material is about 0.3. In another embodiment, the static coefficient of friction to steel of the blade's non-metallic material is less than 0.8 and the static coefficient of friction to steel of the wear buttons' non-metallic material is greater than the static coefficient of friction to steel of the blade's non-metallic material and also less than 0.8. Table 1 below lists exemplary non-metallic materials for either the blades 506 or the wear buttons 508. These non-metallic materials will generally have a coefficient of friction to steel that is less than 0.8 where a value of 0 means there is no friction at all between the objects.

| Non-metallic Material | Static Coefficient of Friction to Steel |
|---|---|
| polymer | 0.7 |
| composite polymer | 0.17 |

-continued

| Non-metallic Material | Static Coefficient of Friction to Steel |
|---|---|
| polytetrafluoroethylene | 0.15 |
| ceramic | 0.30 |
| dicyclopentadiene polymer | 0.40 |
| polyetheretherketone | 0.50 |

The wear buttons 108 may take a variety of shapes and sizes, as long as their exposed wear face 530 is a smooth and rounded for a smooth (non-abrasive) interface with the casing when run into the hole, similar to the embodiments above. In one embodiment, each wear button 508 has a generally spherical shape with an exposed wear face 530 that takes the shape of a curved or rounded face generally aligned with the length of the body 502.

The blades 506 extending outwardly from the body's outer surface 504 and their outermost surfaces 520 define the maximum outer diameter D of the centralizer 500, as seen in FIG. 6. The wear buttons 508 are disposed in each blade 506 such that they do not extend beyond the maximum outer diameter D of the centralizer 500. As such, the exposed wear faces 530 of the wear buttons 508 may be at or just underneath the outermost surface 520 of the blades 506.

In one embodiment, each blade 506 includes one or more recesses 532 that are each positioned and sized to receive a corresponding wear buttons 508. The wear buttons 508 may be chemically fastened, e.g. glued or adhered in place in the recesses 532, or mechanically fastened, i.e. molded in the recesses 532. Alternatively, the wear buttons 508 can be embedded in the blades 506, such as by insert molding them into the blades 506.

Although this invention has been described in connection with specific forms and embodiments thereof, it will be appreciated that various modifications other than those discussed above may be resorted to without departing from the spirit or scope. For example, equivalent elements may be substituted for those specifically shown and described, certain features may be used independently of other features, and in certain cases, particular locations of elements may be reversed or interposed, all without departing from the spirit or scope as defined in the appended Claims.

What is claimed is:

1. A non-metallic centralizer for use with a downhole apparatus, comprising:

a hollow, cylindrical body having an outer surface, the hollow cylindrical body having a plurality of blades protruding outwardly from the outer surface, the plurality of blades being formed of a first non-metallic material; and a plurality of wear buttons associated with one or more of the plurality of blades, each of the plurality of wear buttons being formed of a second non-metallic material, and wherein the second non-metallic material has a static coefficient of friction to steel that is equal to or greater than a static coefficient of friction to steel of the first non-metallic material, and wherein the plurality of wear buttons are configured to reduce abrasive forces exerted upon the centralizer when run into the downhole apparatus.

2. The non-metallic centralizer of claim 1, wherein the static coefficient of friction to steel of the first non-metallic material is less than 0.8 and the static coefficient of friction to steel of the second non-metallic material is greater than the static coefficient of friction to steel of the first non-metallic material and less than 0.8.

3. The non-metallic centralizer of claim 2, wherein the first non-metallic material is a polymer or composite polymer.

4. The non-metallic centralizer of claim 2, wherein the second non-metallic material is a polymer or composite polymer.

5. The non-metallic centralizer of claim 2, wherein the second non-metallic material is polytetrafluoroethylene, polyetheretherketone, dicyclopentadiene polymer, ceramic, carbide, zirconia, or combinations thereof.

6. The non-metallic centralizer of claim 1, wherein the static coefficient of friction to steel of the first non-metallic material is about 0.17 and the static coefficient of friction to steel of the second non-metallic material is about 0.3.

7. The non-metallic centralizer of claim 1, wherein each of the plurality of wear buttons has an exposed wear face that is smooth and rounded.

8. The non-metallic centralizer of claim 1, wherein each of the plurality of blades includes a bevel at each end thereof and at least one of the plurality wear buttons is disposed in the bevel in each end.

9. The non-metallic centralizer of claim 8, wherein each of the plurality of blades includes at least four of the wear buttons, each of the wear buttons being spaced equally apart along a length of each of the plurality of blades.

10. The non-metallic centralizer of claim 8, wherein the plurality of wear buttons are disposed in the one or more of the plurality of blades such that the plurality of wear buttons do not extend beyond a maximum outer diameter of the centralizer defined by the plurality of blades.

11. A non-metallic centralizer for use with a downhole apparatus, comprising:

a hollow, cylindrical body having an outer surface and first and second opposite open ends, the hollow cylindrical body having a plurality of blades protruding outwardly from the outer surface, each of the plurality of blades extending from near or at the first open end to near or at the second open end of the hollow cylindrical body, the plurality of blades defining a maximum outer diameter of the centralizer, the plurality of blades being formed of a non-metallic material; and a plurality of wear buttons disposed in one or more of the plurality of blades such that the plurality of wear buttons do not extend beyond a maximum outer diameter of the centralizer defined by the plurality of blades, each of the plurality of wear buttons being formed of a non-metallic material, wherein the plurality of wear buttons are configured to reduce abrasive forces exerted upon the centralizer when run into the downhole apparatus.

12. The non-metallic centralizer according to claim 11, wherein the plurality of wear buttons are positioned below or at an outermost surface of the one or more of the plurality of blades.

13. The non-metallic centralizer according to claim 12, wherein the one or more of the plurality of blades include recesses in the outer most surface, each recess receives one of the plurality of wear buttons.

14. The non-metallic centralizer according to claim 12, wherein each of the plurality of wear buttons has a smooth wear face that is exposed at the outermost surface of the one or more of the plurality of blades.

15. The non-metallic centralizer according to claim 14, wherein each of the smooth wear faces is rounded.

16. The non-metallic centralizer according to claim 11, wherein each of the plurality of blades has a length between first and second blade ends corresponding to the first and second opposite open ends, respectively, of the cylindrical body, at least one of the plurality of wear buttons is located at each of the first and second blade ends.

17. The non-metallic centralizer of claim 16, wherein one or more of the plurality of wear buttons are located between the first and second ends.

18. The non-metallic centralizer of claim 16, wherein each of the first and second blade ends includes a bevel and the at least one of the plurality of wear buttons is positioned in the bevel of the first and second blade ends.

19. The non-metallic centralizer of claim 11, wherein the non-metallic material of the plurality of wear buttons has a static coefficient of friction to steel that is equal to or greater than a static coefficient of friction of steel of the non-metallic material of the plurality of blades.

20. The non-metallic centralizer of claim 19, wherein the static coefficient of friction to steel of the non-metallic material of the plurality of blades is less than 0.8 and the static coefficient of friction to steel of the non-metallic material of the plurality of wear buttons is greater than the static coefficient of friction to steel of the first non-metallic material and less than 0.8.

21. The non-metallic centralizer of claim 11, wherein the static coefficient of friction to steel of the non-metallic material of the plurality of wear buttons is about 0.17 and the static coefficient of friction to steel of the non-metallic material of the plurality of blades is about 0.3.

* * * * *